US007602357B2

(12) United States Patent
Yamada

(10) Patent No.: US 7,602,357 B2
(45) Date of Patent: Oct. 13, 2009

(54) METHOD AND APPARATUS OF IMAGE SIGNAL PROCESSING

(75) Inventor: Kazuhiro Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 792 days.

(21) Appl. No.: 10/550,068

(22) PCT Filed: Oct. 14, 2004

(86) PCT No.: PCT/JP2004/015551

§ 371 (c)(1),
(2), (4) Date: Sep. 21, 2005

(87) PCT Pub. No.: WO2005/036513

PCT Pub. Date: Apr. 21, 2005

(65) Prior Publication Data

US 2006/0192786 A1 Aug. 31, 2006

(30) Foreign Application Priority Data

Oct. 14, 2003 (JP) ..... 2003-353458

(51) Int. Cl.
*G09G 3/32* (2006.01)

(52) U.S. Cl. ..... 345/82; 345/60; 345/76

(58) Field of Classification Search ..... 345/60–68, 345/76–83, 89

See application file for complete search history.

(56) References Cited

U.S. PATENT DOCUMENTS

| | | | | |
|---|---|---|---|---|
| 7,042,422 | B2 * | 5/2006 | Weitbruch et al. | 345/63 |
| 7,064,731 | B2 * | 6/2006 | Doyen et al. | 345/60 |
| 2004/0008161 | A1 * | 1/2004 | Doyen et al. | 345/60 |

FOREIGN PATENT DOCUMENTS

| | | |
|---|---|---|
| JP | 08-130696 | 5/1996 |
| JP | 11-259044 | 9/1999 |
| JP | 2001-255863 | 9/2001 |
| JP | 2002-014647 | 1/2002 |
| JP | 2003-177698 | 6/2003 |
| JP | 2004-126458 | 4/2004 |
| WO | 02/059864 | 8/2002 |

* cited by examiner

*Primary Examiner*—Richard Hjerpe
*Assistant Examiner*—Kimnhung Nguyen
(74) *Attorney, Agent, or Firm*—Wenderoth, Lind & Ponack, L.L.P.

(57) ABSTRACT

Disclosed here is an image signal processing method and apparatus. In the image signal processing, with the use of characteristically different low-pass filters disposed in parallel, a current-field image signal undergoes low-pass filtering process, and the outputs from the low-pass filters are mixed to produce an extended image signal including a pseudo afterglow signal. The pseudo afterglow signal is added to an area as required.

16 Claims, 9 Drawing Sheets

(a)

gray levels in the bright area=100
gray levels in the dark area=0

(b)

moving area (c)

| | | | | | | | | | | | | | | | | | |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |

(d)

(e)

| | | | | | | | | | | | | | | | | | |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 1 | 0 | 0 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 5 | 5 | 5 | 5 | 5 | 0 | 0 | 0 | 0 | 0 | 0 | 0 | 0 | 0 | 0 |
| 0 | 0 | 6 | 6 | 6 | 6 | 6 | 6 | 0 | 0 | 0 | 0 | 0 | 0 | 0 | 0 | 0 | 0 |
| 0 | 0 | 0 | 4 | 4 | 4 | 4 | 0 | 0 | 0 | 0 | 0 | 0 | 0 | 0 | 0 | 0 | 0 |
| 0 | 0 | 0 | 2 | 2 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |

| movement velocity | tap values |
|---|---|
| 0 | 0 |
| 1 | 1 |
| 2,3,4 | 4 |
| 5,6,7 | 8 |
| 8 ~ | 16 |

FIG. 5

(a) image signal

| | | | | | | | | | | | |
|---|---|---|---|---|---|---|---|---|---|---|---|
| 0 | 0 | 0 | 0 | 0 | 0 | 0 | 100 | 100 | 100 | 100 | 100 |
| 0 | 0 | 0 | 0 | 0 | 0 | 0 | 100 | 100 | 100 | 100 | 100 |
| 0 | 0 | 0 | 0 | 0 | 0 | 0 | 100 | 100 | 100 | 100 | 100 |
| 0 | 0 | 0 | 0 | 0 | 0 | 0 | 100 | 100 | 100 | 100 | 100 |

(b) tap value

| | | | | | | | | | | | |
|---|---|---|---|---|---|---|---|---|---|---|---|
| 0 | 0 | 0 | 4 | 4 | 4 | 4 | 0 | 0 | 0 | 0 | 0 |
| 0 | 0 | 0 | 4 | 4 | 4 | 4 | 0 | 0 | 0 | 0 | 0 |
| 0 | 0 | 0 | 4 | 4 | 4 | 4 | 0 | 0 | 0 | 0 | 0 |
| 0 | 0 | 0 | 4 | 4 | 4 | 4 | 0 | 0 | 0 | 0 | 0 |

(c) LPF1 tap value x 1
current-field
image signal x 0.5

| | | | | | | | | | | | |
|---|---|---|---|---|---|---|---|---|---|---|---|
| 0 | 0 | 0 | 6 | 12 | 18 | 25 | 50 | 50 | 50 | 50 | 50 |
| 0 | 0 | 0 | 6 | 12 | 18 | 25 | 50 | 50 | 50 | 50 | 50 |
| 0 | 0 | 0 | 6 | 12 | 18 | 25 | 50 | 50 | 50 | 50 | 50 |
| 0 | 0 | 0 | 6 | 12 | 18 | 25 | 50 | 50 | 50 | 50 | 50 |

(d) LPF2 tap value x 0.5
current-field
image signal x 1

| | | | | | | | | | | | |
|---|---|---|---|---|---|---|---|---|---|---|---|
| 0 | 0 | 0 | 0 | 0 | 25 | 50 | 100 | 100 | 100 | 100 | 100 |
| 0 | 0 | 0 | 0 | 0 | 25 | 50 | 100 | 100 | 100 | 100 | 100 |
| 0 | 0 | 0 | 0 | 0 | 25 | 50 | 100 | 100 | 100 | 100 | 100 |
| 0 | 0 | 0 | 0 | 0 | 25 | 50 | 100 | 100 | 100 | 100 | 100 |

(e) LPF3 tap value x 0.25
current-field
image signal x 2

| | | | | | | | | | | | |
|---|---|---|---|---|---|---|---|---|---|---|---|
| 0 | 0 | 0 | 0 | 0 | 0 | 100 | 200 | 200 | 200 | 200 | 200 |
| 0 | 0 | 0 | 0 | 0 | 0 | 100 | 200 | 200 | 200 | 200 | 200 |
| 0 | 0 | 0 | 0 | 0 | 0 | 100 | 200 | 200 | 200 | 200 | 200 |
| 0 | 0 | 0 | 0 | 0 | 0 | 100 | 200 | 200 | 200 | 200 | 200 |

(f) extended image signal

| | | | | | | | | | | | |
|---|---|---|---|---|---|---|---|---|---|---|---|
| 0 | 0 | 0 | 6 | 12 | 25 | 100 | 200 | 200 | 200 | 200 | 200 |
| 0 | 0 | 0 | 6 | 12 | 25 | 100 | 200 | 200 | 200 | 200 | 200 |
| 0 | 0 | 0 | 6 | 12 | 25 | 100 | 200 | 200 | 200 | 200 | 200 |
| 0 | 0 | 0 | 6 | 12 | 25 | 100 | 200 | 200 | 200 | 200 | 200 |

METHOD AND APPARATUS OF IMAGE SIGNAL PROCESSING

TECHNICAL FIELD

The present invention relates to a method and apparatus of image signal processing for driving a color image display device that employs a plurality of light-emitting materials having difference in afterglow-lasting time.

BACKGROUND ART

A plasma display panel (PDP) has received widespread attention as a color image display device having a large screen. PDPs employ phosphors of three colors of green, red, and blue as light-emitting material, which are emitted by ultraviolet excitation. However, only a few of the materials satisfy required conditions, such as luminous intensity, and color purity. In a real-time situation, manufacturers have been searching for a desirable combination of green, red, and blue phosphor materials that entirely satisfies the conditions.

Among of all the conditions, afterglow characteristics of phosphors considerably depend on the color, particularly, there is a big difference between the phosphor emitting blue and the phosphor emitting green. For example, $BaMgAl_{10}O_{17}$:Eu, which is a typical blue phosphor, exhibits afterglow that lasts a few μs, whereas $Zn_2SiO_4$:Mn used for a green phosphor has long-lasting afterglow close to a TV field of approx. 16.7 ms (where, the afterglow-lasting time is represented on a scale of one tenth). Due to the difference in afterglow-lasting time, a moving image is sometimes accompanied by an unintended color that was not included in the original image. More specifically, when a bright point moves in an image, a green "tail" appears behind the bright point, or in another case, when the screen changes into dark, a green image remains on the screen. In particular, skin of a figure image accompanied by a green tail with high relative luminous efficiency is an eyesore, deteriorating image quality.

To address the deterioration in image quality due to the difference in afterglow-lasting time, there are some suggestions. For example, with respect to an image signal corresponding to the color emitted by the phosphor having a short afterglow time, an additional image signal (hereinafter referred to as a pseudo afterglow signal) is generated, and the pseudo afterglow signal is added to the original image signal so as to correspond with the length of afterglow of other colors. One of the suggestions introduces a method of improving the image quality by adding one-field-before image signal as the pseudo afterglow signal to the current-field image signal at a uniform rate (for example, see Japanese Patent Unexamined Publication No. 2002-14647).

However, the method above—the image signal of the previous field is simply added as the pseudo afterglow signal to the image signal of the current field at a uniform rate—can invite inconveniences. For example, in the display having a bright, white window pattern moving against a dark background, color difference generated in the area having afterglow can increase mismatch feeling in color change. The mismatch rests on the fact that natural afterglow can be seen with exponential attenuation as it goes away from the window pattern, whereas the pseudo afterglow, which is generated by adding one-field before image signal to the image signal of the current field, is no longer dependent on the distance from the window pattern.

It is the object of the present invention to provide a method and apparatus of image signal processing capable of maintaining the color of afterglow the same as that of the original image to improve image quality even in the image display using a color image display device having a plurality of light-emitting materials having a difference in afterglow-lasting time.

DISCLOSURE OF THE INVENTION

To achieve the aforementioned object, the image signal processing of the present invention adds a pseudo afterglow signal to the image signal corresponding to the light-emitting material having a short afterglow time in such a way that the current-field image signal undergoes characteristically different low-pass-filtering processes provided in parallel; the signals filtered out of each filtering process are combined to create an extended image signal containing the pseudo afterglow signal; and the extended image signal is mixed with the current-field image signal and the mixed signal is applied only to the area being in need of the application.

BRIEF DESCRIPTION OF THE DRAWINGS

FIG. 5 illustrates characteristically different low-pass filters disposed in a structure of the embodiment.

DETAILED DESCRIPTION OF CARRYING OUT OF THE INVENTION

A method and apparatus of image signal processing according to an exemplary embodiment of the present invention is described hereinafter with reference to the accompanying drawings. The description here is given on the assumption that the green phosphor has the longest afterglow time, the red phosphor follows, and the blue phosphor has an extremely short afterglow time, as in the case of the phosphors employed in PDPs.

Figure 1:
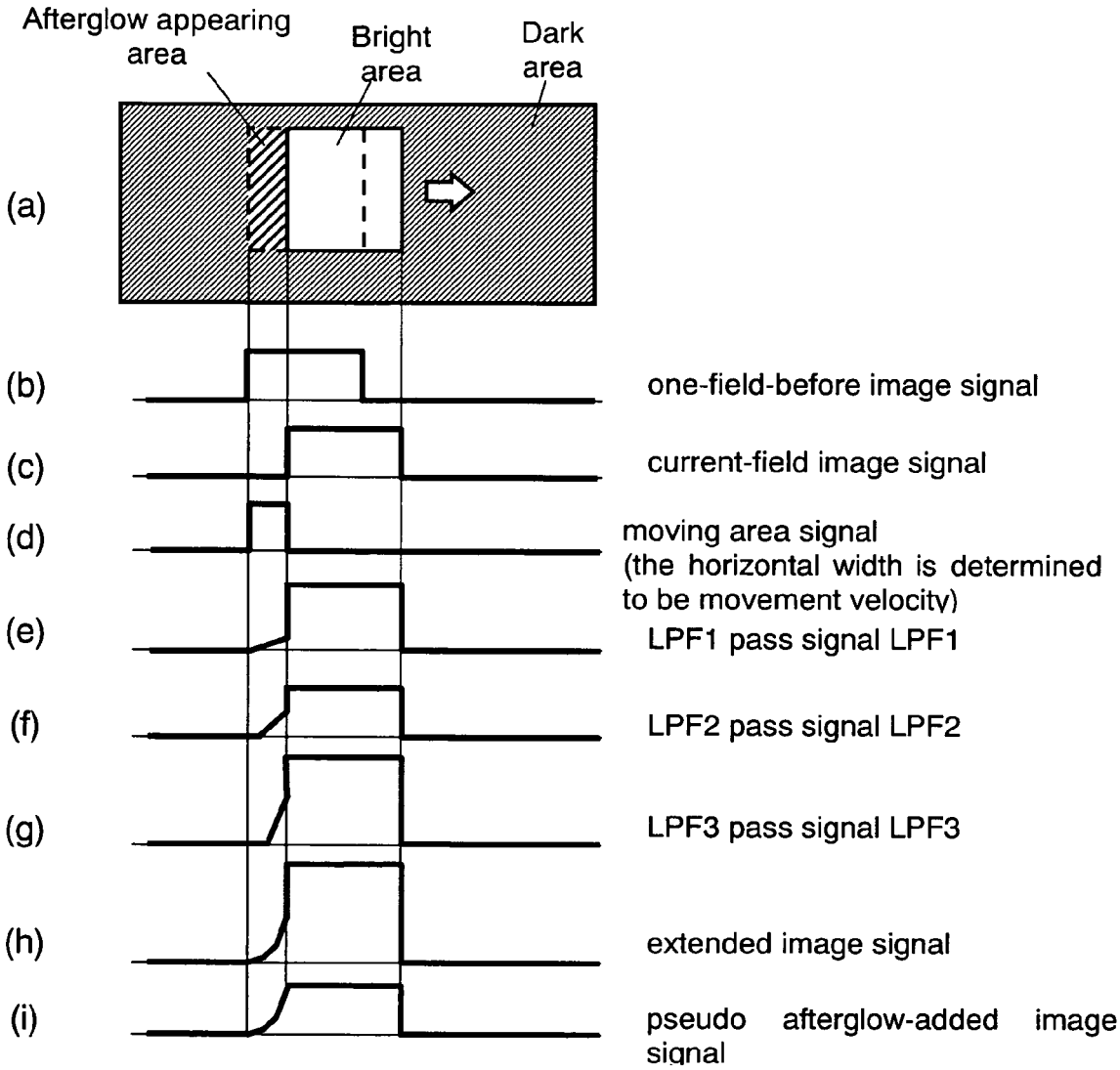
FIG. 1 illustrates the method of adding pseudo afterglow to display image of an exemplary embodiment of the present invention.

FIG. 1 illustrates the method of adding pseudo afterglow in the image signal processing apparatus of the present invention. For example, as a white window pattern moves to the right in FIG. 1(*a*), yellow-tailed afterglow appears on the left side of the moving pattern. In the embodiment, to make the color of the afterglow white the same as the color of the window pattern, a pseudo afterglow signal is added to the image signal of blue.

Hereinafter will be described the basic idea of adding the pseudo afterglow signal. Generally, in the image display aired on a TV, it is a well-known fact that movement in the direction of scanning lines, i.e., the horizontal movement is seen at frequent intervals, compared to the vertical movement. Considering this, the description in the embodiment focuses on the horizontal movement for simplification of the circuits of the structure.

First, a length of the "tail" of pseudo afterglow to be added is calculated. The tail length depends on movement velocity of an image; a moving area is detected prior to calculating the tail length. Afterglow appears at a dark current field changed from a bright one-field-before field. Now suppose that luminance of the one-field-before field is represented by $L_{f-1}$; luminance of the current field is represented by $L_f$; the difference between $L_{f-1}$ and $L_f$ (i.e., $L_{f-1}-L_f$) is represented by $\Delta L$; and the threshold that depends on afterglow characteristics of light-emitting material is represented by Lth. When difference $\Delta L$ takes a value smaller than threshold Lth, afterglow has less contribution to picture degradation. That is, practically, the pseudo afterglow is added only to the pixel area that satisfies $(L_{f-1})-L_f>Lth$.

As shown in FIGS. 1(*b*), 1(*c*), and 1(*d*), the differential signal between the current-field image signal and the one-field-before image signal is obtained, and the area in which the differential signal takes a value greater than threshold Lth is determined to be a moving area. The horizontal width of the moving area is determined to be movement velocity.

Figure 2:
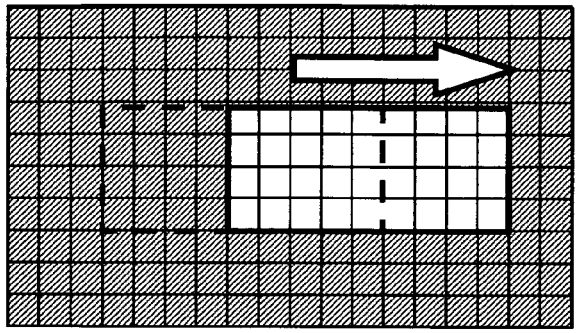
FIG. 2 illustrates the relation between a moving area and movement velocity of the embodiment.
Figure 2:
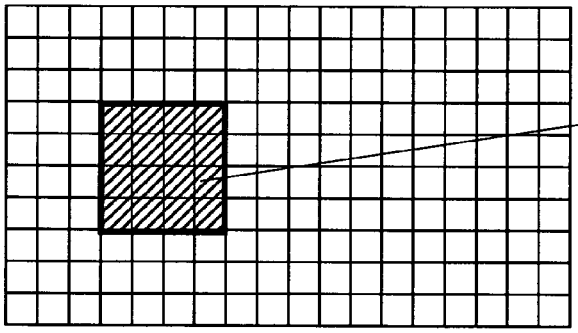
Figure 2:
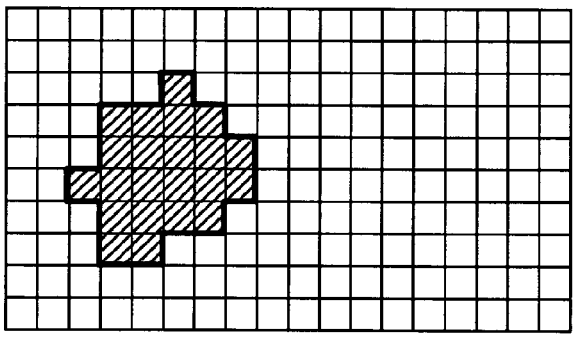

For example, when the white window moves rightward by 4 pixels in one field, as shown in FIG. 2(*a*), the moving area is the area indicated by oblique lines in FIG. 2(*b*). In this case, the movement has 4-pixel horizontal width, and the moving area moves at a uniform movement velocity of "4" in all the pixels of the area. When the moving area has a shape as shown in FIG. 2(*d*), the movement velocity of each pixel in the moving area is shown in FIG. 2(*e*).

Figures 3, 4:
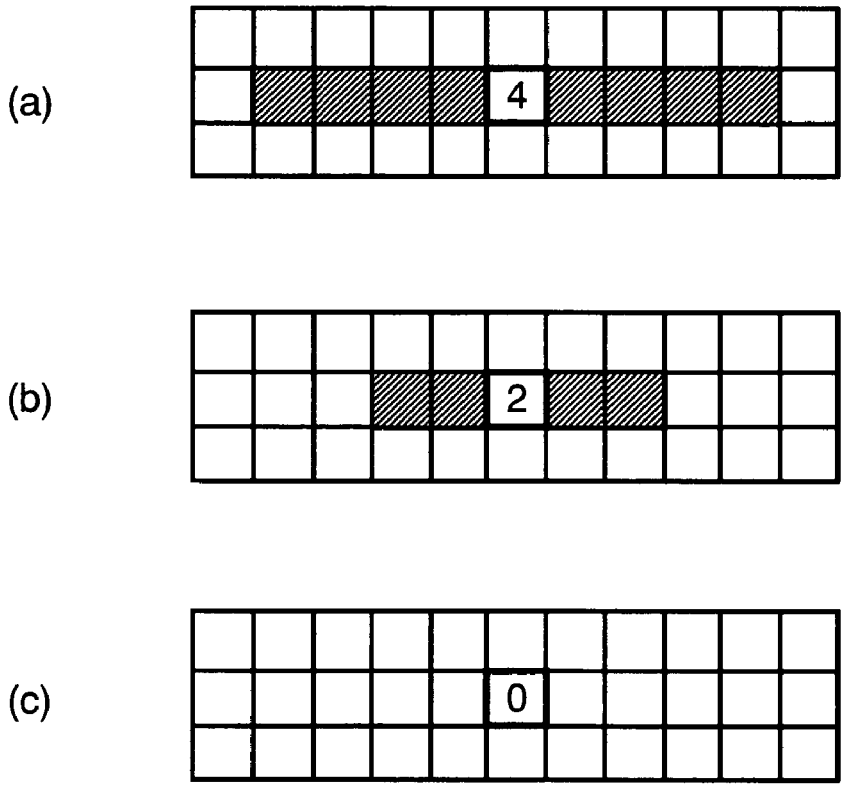
FIG. 3 shows the correspondence of the movement velocity and tap values of the embodiment.
FIG. 4 illustrates the workings of the low-pass filter employed in the embodiment.

The movement velocity obtained above can represent a tail length of pseudo afterglow; however, when an image pattern moves at a high movement velocity, the movement produces afterglow extending over 2 fields. In this case, the tail length of pseudo afterglow differs from that of actual afterglow. To address the inconvenience, the movement velocity is converted to value T (hereinafter, tap T), which corresponds to a tail length of actual afterglow. FIG. 3 is a correspondence table of the movement velocity and tap T for the conversion. Each tap T of the table is finally corresponds to the tail length of pseudo afterglow. In the conversion process, defining tap T so as to take a value of 0 or of powers of 2 can simplify the calculation in the following process—the division in average calculation can be done by bit-shifting; accordingly, the calculation circuits can be simply formed (as will be described later.) In this way, the movement velocity derived from the moving area is converted into tap T according to a predetermined rule corresponding to afterglow characteristics of each phosphor.

As the next step, a pseudo afterglow signal is obtained. In the embodiment of the present invention, an extended image signal is calculated as follows: multiply the current-field image signal shown in FIG. 1(*c*) by a predetermined value; process the calculated value by low-pass-filtering with the use of characteristically different three low-pass filters LPF1, LPF2, LPF3; combine the three outputs from the filters and generate an extended image signal including a pseudo afterglow signal. FIGS. 1(*e*), 1(*f*), and 1(*g*) show the outputs from low-pass filters LPF1, LPF2, and LPF3, respectively. Of the three outputs, the largest one is selected to produce the extended image signal shown in FIG. 1(*h*).

The low-pass filter of the embodiment provides low-pass filtering by calculating the average of image signals that correspond to a predetermined number of pixels disposed rightward and leftward from a target pixel. To produce difference in characteristics in each low-pass filter, each number of pixels disposed on the right and on the left sides of a target pixel is determined by multiplying tap T calculated above by predetermined constant n (hereinafter, compression constant n), i.e, T×n. FIG. 4 illustrates the workings of the low-pass filter. Here will be described the average calculation when T×n=4. For example, when tap T of the target pixel takes 4, and compression constant n takes 1, the low-pass filter obtains an average of image signals corresponding to the 8 pixels (summed up each 4 pixels on the right and on the left sides of the target pixel) of FIG. 4(*a*) indicated by oblique lines, and outputs the result as the image signal corresponding to the target signal. When tap T of the target pixel takes 2, and compression constant n takes 1, the low-pass filter obtains an average of image signals corresponding to the 4 pixels (summed up 2 pixels each rightward and leftward from the target pixel) of FIG. 4(*b*) indicated by oblique lines, and outputs the average as the image signal corresponding to the target signal. When tap T takes 0, as shown in FIG. 4(*c*), the low-pass filter outputs, without average calculation, the image signal corresponding to the target signal.

As described above, the low-pass filter defines compression constant n (n takes a constant); multiplies the current-field image signal corresponding to T×n pixels disposed rightward and leftward from the target pixel by a predetermined value; and then obtains the average of the result calculated above. Employing the low-pass filter above eliminates the need for assigning weights to each pixel; accordingly, there is no need to use adders and the like. Besides, when the number of pixels to be averaged is determined to be a value represented by powers of 2, the division can be simply done by bit-shifting, whereby the calculation circuits can be simply structured.

FIG. 5 is an example of the filtering process by characteristically different low-pass filters. LPF1 has compression constant n of "1" and receives an image signal obtained by multiplying the current-field image signal by 0.5. Now suppose that the current-field image signal is shown in FIG. 5(*a*), and tap T corresponding to the image signal is shown in FIG. 5(*b*). Receiving the current-field image signal, LPF1 multiplies the signal by 0.5, and obtains the average of image signals corresponding to the 8 pixels summed up each 4 pixels rightward and leftward from the pixel having tap T of 4, and then outputs the result as the image signal corresponding to the target pixel. LPF1 thus obtains the image signal shown in FIG. 5(*c*).

LPF2 has compression constant n of 0.5 and receives the current-field image signal as it is. LPF2 obtains the average of image signals corresponding to the 4 pixels as a total of each 2 pixels rightward and leftward from the pixel having tap T of 4, and then outputs the result as the image signal corresponding to the target pixel. LPF2 thus obtains the image signal shown in FIG. 5(*d*).

LPF3 has compression constant n of 0.25. Receiving the current-field image signal, LPF3 multiplies the signal by 2, and obtains the average of image signals corresponding to the 2 pixels, i.e., the pixels adjacent right and left to the pixel having tap T of 4, and then outputs the result as the image signal corresponding to the target pixel. LPF3 thus obtains the image signal shown in FIG. 5(*e*).

By selecting the maximum value from each output of LPF1, LPF2, LPF3, the extended image signal, as shown in Fig. (f), is finally obtained.

The extended image signal, as described above, is acquired through the process of: determining tap T (T takes an integer) for each pixel prior to low-pass filtering; providing the current-field image signal with the low-pass filtering according to the value of tap T by characteristically different low-pass filters; and selecting the largest output from the low-pass filters.

When compression coefficient n is determined to be powers of 2 or to be the reciprocal of powers of 2, the division in average calculation can be done by bit-shifting; accordingly, the circuits for calculation can be simply formed. Each of low-pass filters LPF1, LPF2, and LPF3 performs a simple moving average calculation. Therefore, the extended portion of an output image has, as shown in FIGS. 5(*c*)-5(*e*), a linear change. However, combining each output from the characteristically different low-pass filters can generate a pseudo afterglow signal with exponential change in luminance, as shown in the framed area by solid lines in FIG. 5(*f*). That is, with no use of a low-pass filter having a complex coefficient matrix, or a cyclic low-pass filter, the structure of the embodiment can produce realistic-looking pseudo afterglow with a simple circuit. Although the exponential functions are approximated by broken lines, viewers see image display with no practical awareness of the approximation method. When a low-pass filter having a complex coefficient matrix is employed, the circuit structure is inconveniently increased in scale. In contrast, the structure having the low-pass filter of the embodiment can be simply formed, which enables the number of tap T to change for each pixel according to movement velocity. With the structure, the extended image including looking-real pseudo afterglow—giving long-tailed afterglow for the area with quick movement, and short-tailed afterglow for the area with a slow movement—can thus be obtained.

Although each low-pass filter has the following setting conditions, that is, having compression coefficient of 1, LPF1 receives a signal multiplied the current-field image signal by 0.5; having compression coefficient of 0.2, LPF2 receives a signal multiplied the current-field image signal by 1; having compression coefficient of 0.25, LPF3 receives a signal multiplied the current-filed image signal by 2, it is not limited thereto. The setting conditions should preferably be determined according to afterglow characteristics of the phosphor to be employed. For example, in some cases, the following setting may be preferable: having compression coefficient of 1, LPF1 receives a signal multiplied the current-field image signal by 0.25; having compression coefficient of 0.5, LPF2 receives a signal multiplied the current-field image signal by 0.5; having compression coefficient of 0.25, LPF3 receives a signal multiplied the current-filed image signal by 1.

Although the embodiment gives description taking a case in which three low-pass filters are employed, it is not limited thereto; having at least two low-pass filters can produce the extended image signal including looking-real pseudo afterglow signal.

As a next step, the pseudo afterglow signal is added to the one-field-before image signal. According to the embodiment, when the extended image signal is greater than the current-field image signal in the area where the current-field image becomes darker than the previous field image, the current-field image signal is replaced with the extended image signal to obtain the pseudo afterglow-added image signal. FIG. 1(*i*) shows the pseudo afterglow-added image signal. As described above, an afterglow-added image signal is produced by outputting either the extended image signal or the current-field image signal according to the comparison between the extended image signal and the current-field image signal, and then adding the current-field image signal to the extended image signal.

According to the image signal processing method of the embodiment, as described above, with respect to at least image signals corresponding to a light-emitting material with afterglow lasting a short time, a pseudo afterglow signal having a broken line-shaped luminous change is produced according to the current-field image signal, and the pseudo afterglow signal is added to the current-field image signal. In addition, with respect to at least image signals corresponding to a light-emitting material with afterglow lasting a short time, the current-field image signal is fed to characteristically different low-pass filters disposed at branches in the circuit, and then each output obtained by the low-pass filtering is added to produce an extended image signal including pseudo afterglow. For the area in which the extended image signal is greater than the current-field image signal, a pseudo afterglow signal is added to the current-field image signal by mixing the current-field image signal with the extended image signal.

Figure 6:
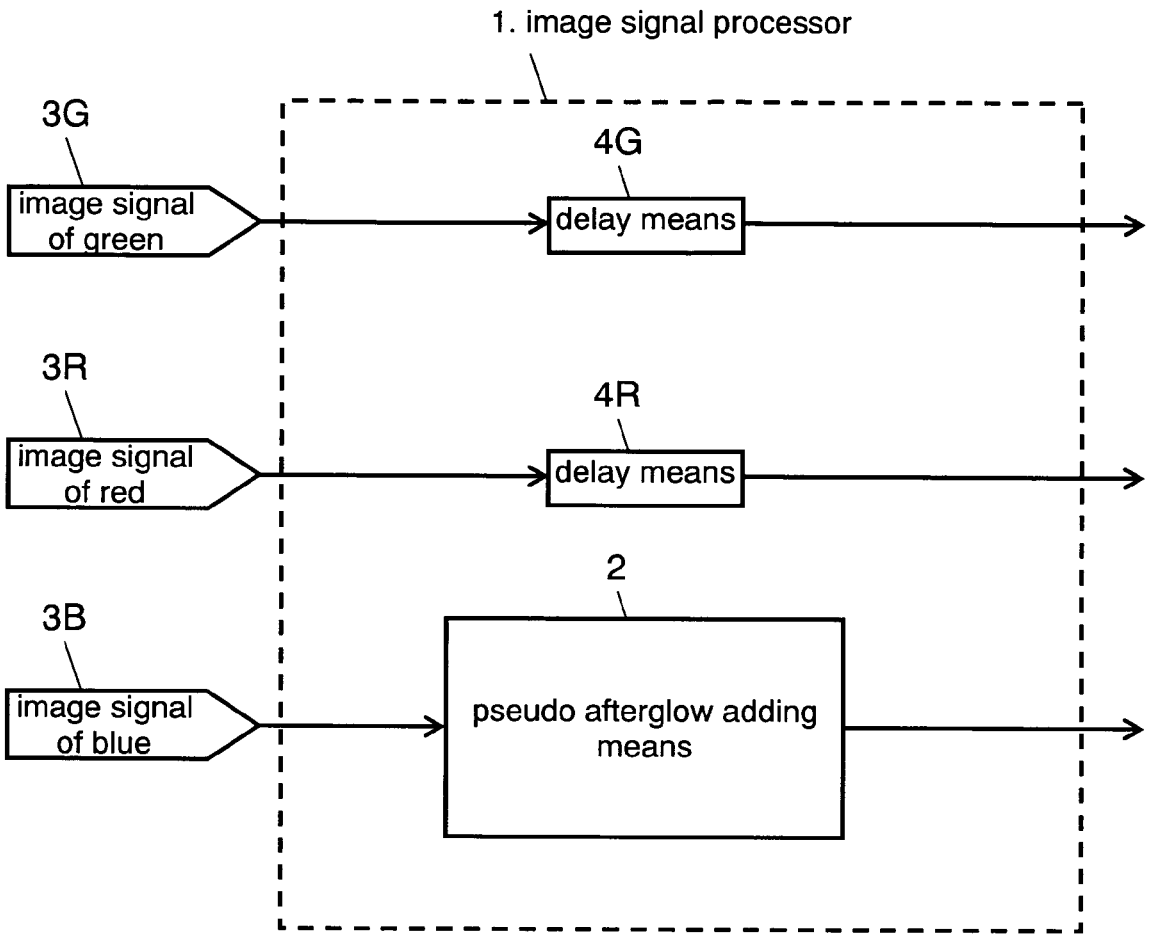
FIG. 6 is a functional block diagram illustrating an image signal processing apparatus of the embodiment.

FIG. 6 is a functional block diagram illustrating image signal processor 1 of the embodiment. Image signal processor 1 contains pseudo afterglow adding means 2 for adding a pseudo afterglow signal; and delay means 4G, 4R for delaying time equivalent to the process time used in pseudo afterglow adding means 2. Blue image signal 3B, which corresponds to a blue phosphor having a short afterglow time, is fed into pseudo afterglow adding means 2. On the other hand, green image signal 3G and red image signal 3R are fed into delay means 4G and 4R, respectively.

Figure 7:
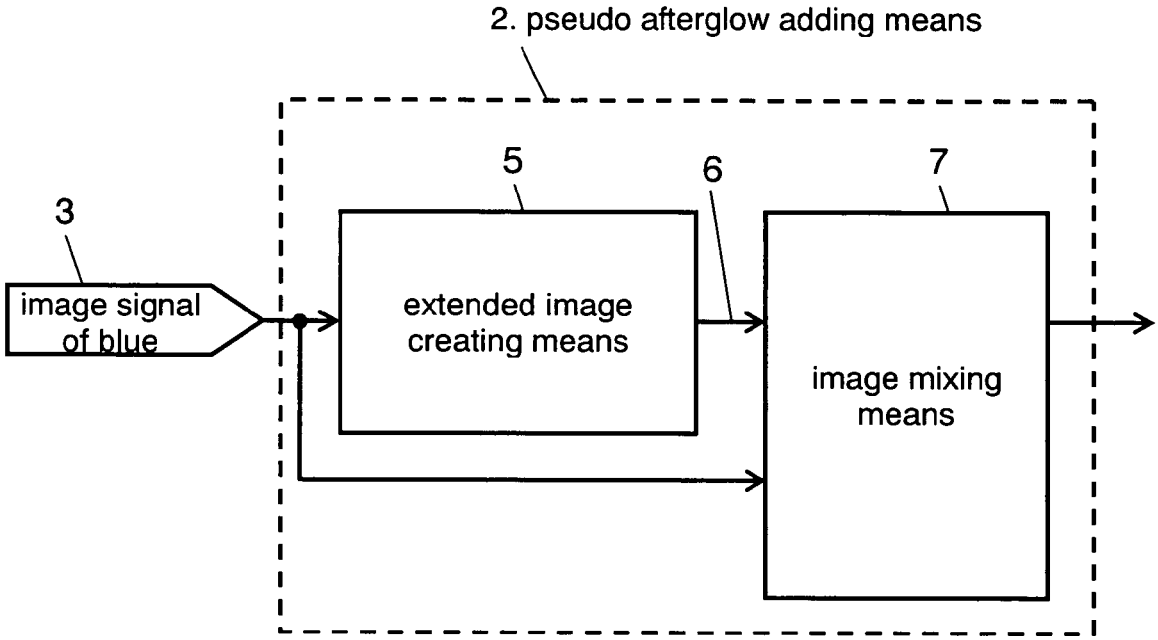
FIG. 7 is a functional block diagram illustrating the pseudo afterglow adding means of the image signal processing apparatus.
Figure 8:
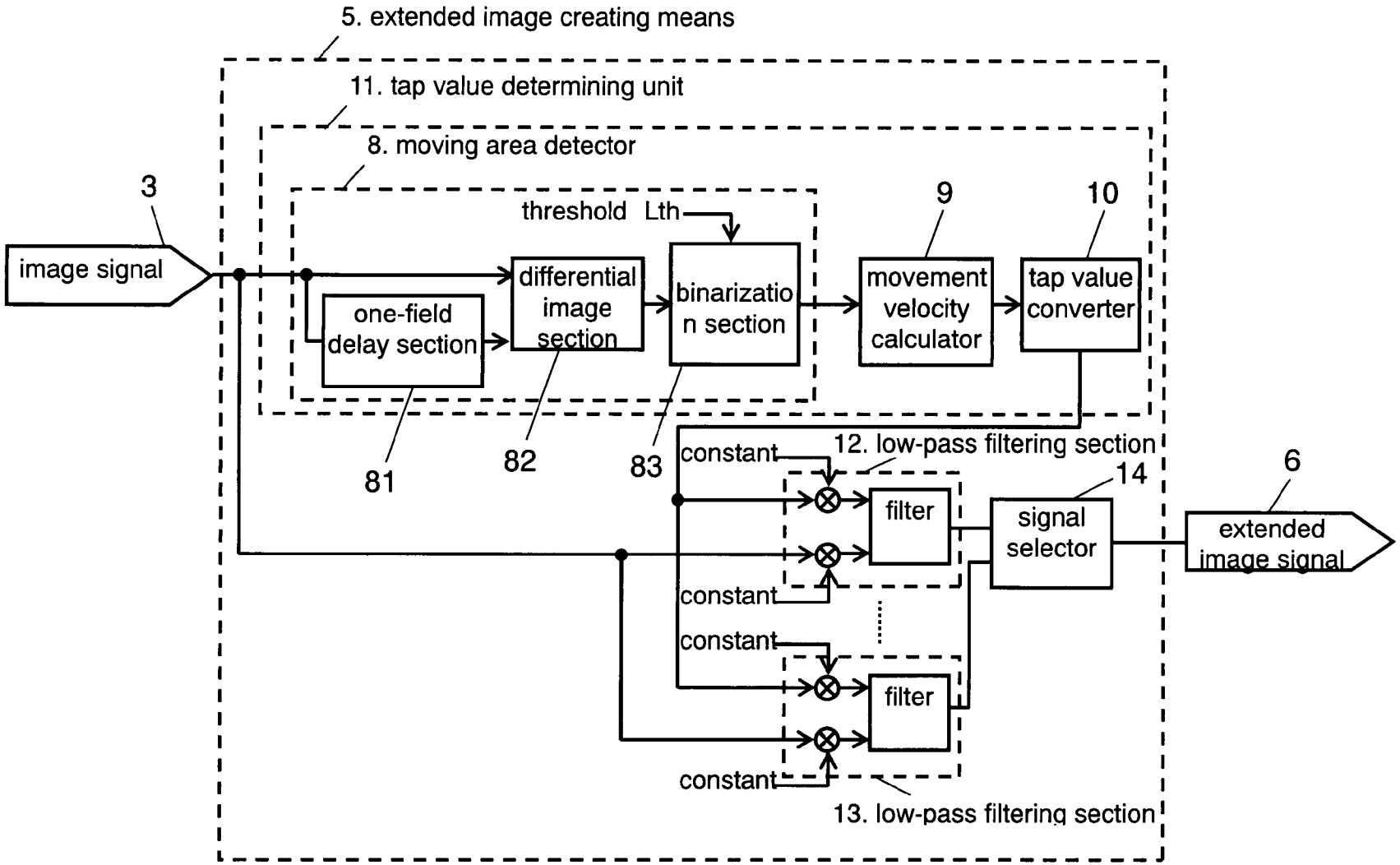
FIG. 8 is a functional block diagram illustrating the extended image creating means of the apparatus.

FIG. 7 is a functional block diagram illustrating the structure of pseudo afterglow adding means 2. Pseudo afterglow adding means 2 contains extended image creating means 5 and image mixing means 7. Receiving image signal 3, extended image creating means 5 generates extended image signal 6 including a pseudo afterglow signal. Image mixing means 7 produces a pseudo afterglow signal-added image signal by selecting either image signal 3 or extended image signal 6. FIG. 8 is a functional block diagram illustrating in detail the structure of image generating means 5. Extended image signal generating means 5 contains tap value determining unit 11 for determining the value of tap T (T takes an integer) for each pixel for the low-pass filtering; characteristically different low-pass filtering sections 12 and 13, which correspond to aforementioned low-pass filters LPF1 through LPF3, for providing the current-field image signal with the low-pass filtering according to tap T defined at tap value determining unit 11; and signal selector 14 for selecting the largest one in the outputs fed from the low-pass filters.

Tap value determining unit 11 contains moving area detector 8 for detecting a moving area according to the differential signal between the current-field image signal and one-field-before image signal; movement velocity calculator 9 for determining movement velocity of an image pattern from the moving area; and tap value converter 10 for converting the movement velocity fed from movement velocity calculator 9 into tap T according to a predetermined rule. Movement velocity calculator 9 obtains movement velocity for each pixel, as shown in FIG. 2(*c*), by measuring the vertical width of the moving area. Receiving the movement velocity, tap value converter 10 converts the velocity into tap T so that tap T takes 0 or values of powers of 2, as shown in FIG. 3.

Moving area detector 8 contains one-field delay section 81 for generating a one-field-before image signal by providing current-field image signal 3 with one-field delay; differential image section 82 for calculating the differential signal between current-field image signal 3 and the one-field-before image signal generated in one-field delay section 81; and binarization section 83 for binarizing the differential signal according to threshold Lth that depends on the afterglow characteristics of light-emitting material and detecting a moving area in which the differential signal is greater than threshold Lth. In the embodiment, threshold Lth is determined to be 100 for the image signal having 256 levels of gray. The value is experimentally obtained in consideration of afterglow characteristics of the phosphor employed for the image display device and various conditions, such as driving operations of the device.

Each of low-pass filtering sections 12 and 13 contains a tap value multiplier that defines compression coefficient n (n takes an integer) and multiples tap T by compression coefficient n; an image multiplier for multiplying the current-field image signal by a predetermined value; and a filter that receives, from the image multiplier, the output signals corresponding to T×n pixels disposed rightward and T×n pixels disposed leftward from a target pixel, and calculates the average of the output signals. Low-pass filtering sections 12 and 13 provide the current-field image signal with parallel low-pass filtering by a plurality of characteristically different low-pass filters. In the process above, compression coefficient n is determined to be powers of 2 or to be the reciprocal of powers of 2.

Signal selector 14 selects the largest output, through pixel-by-pixel comparison, from the outputs from the low-pass filters of low-pass filtering sections 12 and 13, and then outputs the largest one as extended image signal 6.

Figure 9:
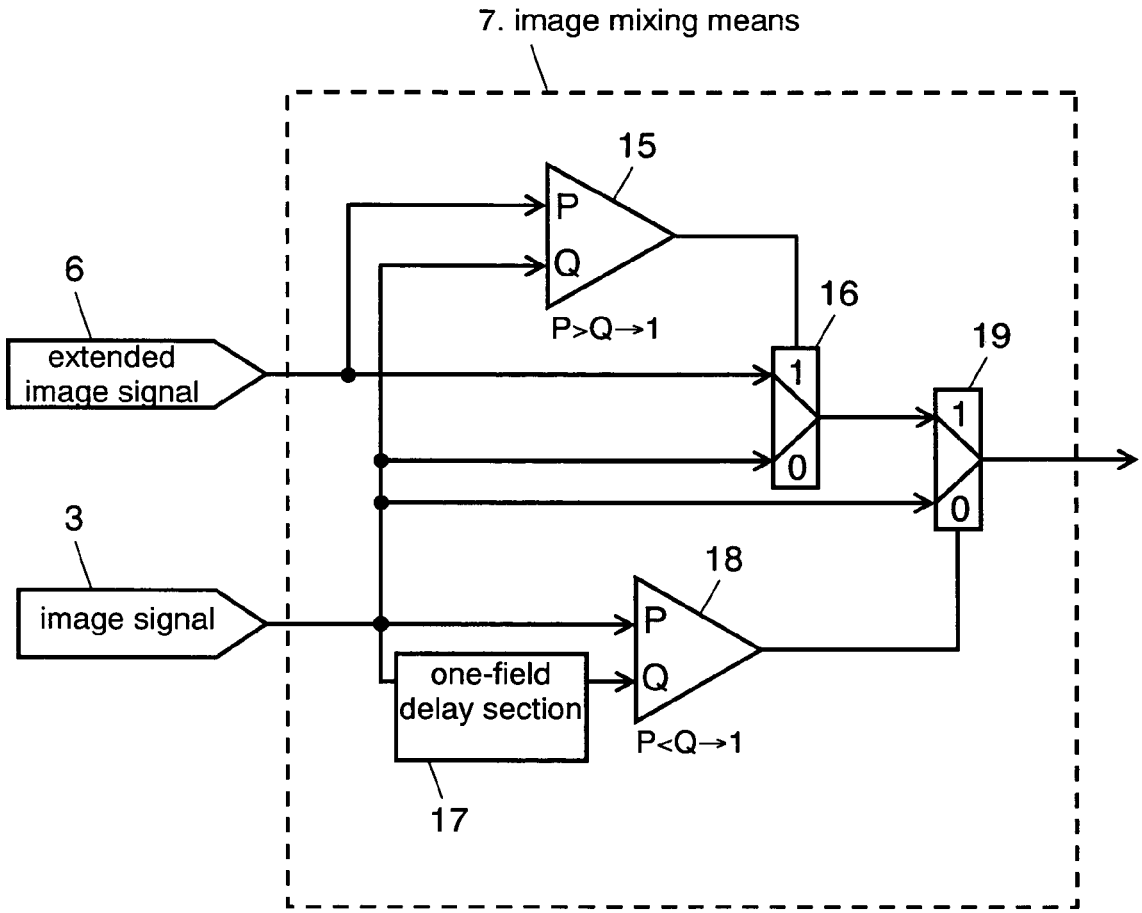
FIG. 9 is a functional block diagram illustrating the image mixing means of the apparatus.

FIG. 9 is a functional block diagram illustrating image mixing means 7. Image mixing means 7 contains signal comparing section 15 for comparing extended image signal 6 with current-field image signal 3; and signal selecting section 16 for determining either extended image signal 6 or current-field image signal 3 according to the output from signal comparing section 15. That is, extended image signal 6 and current-field image signal 3 are compared with each other in signal comparing section 15, and the larger one is selected in signal selecting section 16. One-field delay section 17 generates one-field-before image signal by providing current-field image signal 3 with one-field delay. Signal selecting section 18 compares image signal 3 with the one-field-before image signal. When the one-field delay image signal is larger than current-field image signal 3, signal selecting section 19 outputs the output selected in signal selecting section 16; otherwise, outputs current-field image signal 3. Sharing the use of one-field delay section 17 and one-field delay section 81 contributes to a simplified circuit structure.

With the structure of pseudo afterglow adding unit 2, as described above, a pseudo afterglow-added image can be obtained. In practical use, a large scale integrated circuit (LSI) for digital signal processing can be employed for the circuit structure having the function blocks described above.

Figure 10:
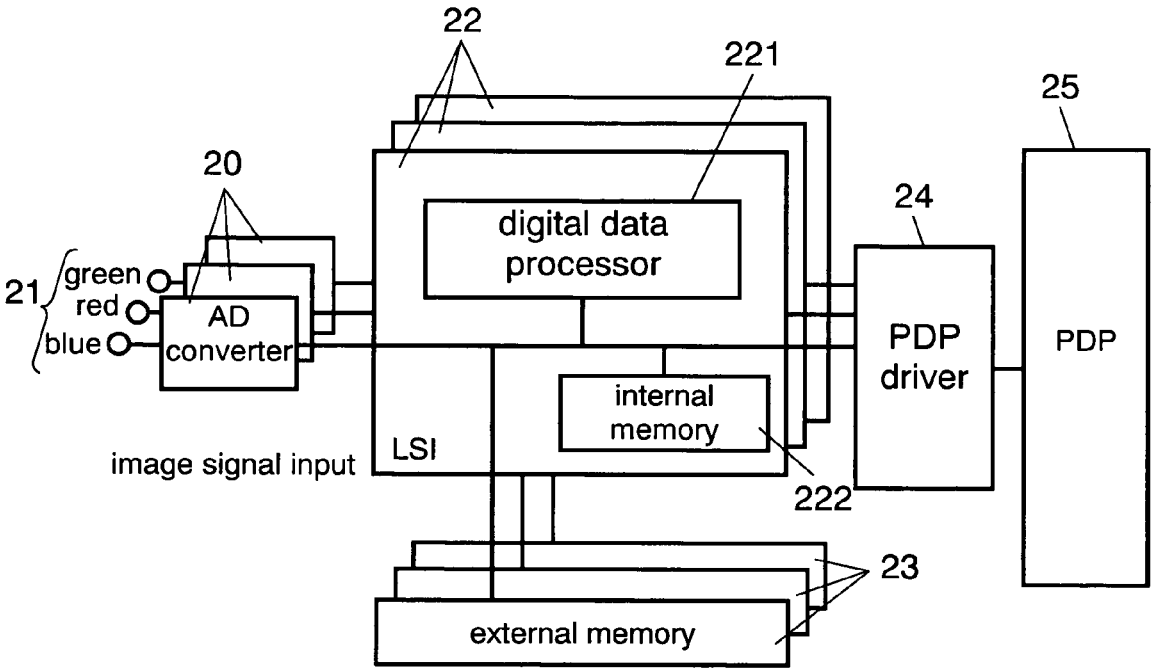
FIG. 10 is a block diagram illustrating circuitry of the apparatus.

FIG. 10 is a circuit block diagram of a PDP driver employing the image signal processing apparatus of the embodiment. AD converter 20 provides image signal 21 of green, red, and blue with analog-to-digital (AD) conversion. In digital data processor 221 in LSI 22, with the use of internal memory 222 and external memory 23, green and red image signals undergo the delay process, while blue signals undergo pseudo afterglow adding process. After that, image signal 21 undergo predetermined data processing and is fed into PDP driver 24. Receiving image signal 21, PDP driver 24 drives PDP 25 to display images.

The image signal processing apparatus of the embodiment of the present invention, as described above, contains the pseudo afterglow adding means for adding a pseudo afterglow image signal to the image signal for blue corresponding to a blue phosphor having short afterglow time. The pseudo afterglow adding means further contains extended image signal generating means and image generating means. The extended image signal generating means provides the current-field image signal with low-pass filtering process by characteristically different low-pass filters, and combines the outputs from each low-pass filters to generate an extended image signal including a pseudo afterglow signal. The image generating means mixes the current-field image signal with the extended image signal to add the pseudo afterglow signal to the current-field image signal for the area in which one-field before image signal is greater than the current-field image signal. The pseudo afterglow adding means adds pseudo afterglow having a broken line-shaped attenuation to image signals for blue color, thereby controlling the afterglow-lasting period of each image of green, red, and blue so as to be visually the same. As a result, afterglow has a color the same as that of its original image, which can offer viewers natural image display.

In some display devices, such as a PDP in which a TV field is divided into sub-fields each of which is differently weighed, viewers often recognize gray levels different from the intended display in the moving picture area, due to a "cumulative" effect of the eyes—known as the dynamic pseudo contour. To avoid the phenomenon, for example, limited gray levels insusceptible to the dynamic pseudo contour are used for the area to which pseudo afterglow has been added. That is, it is preferable to use a driving method that is insusceptible to the dynamic pseudo contour, or that can suppress the dynamic pseudo contour to a negligible level.

The method and apparatus of image signal processing of the present invention can improve image quality by controlling afterglow to have a color the same as that of the original image even in the image display apparatus employing a color image display device having a plurality of light-emitting materials having difference in afterglow-lasting time.

INDUSTRIAL APPLICABILITY

The method and apparatus of image signal processing of the present invention can control afterglow to maintain a color the same as that of the original image even in the image display apparatus employing a color image display device having a plurality of light-emitting materials having difference in afterglow-lasting time. It is therefore useful to improve the image quality of a driving apparatus employing a color image display device, such as a PDP, which has a plurality of light-emitting materials having difference in afterglow-lasting time.

REFERENCE MARKS IN THE DRAWINGS

1: image signal processor
2: pseudo afterglow adding means
3, 3G, 3R, 3B: image signal
4G, 4R: delay means
5: extended image creating means
6: extended image signal
7: image mixing means
8: moving area detector
9: movement velocity calculator
10: tap value converter
11: tap value determining unit
12, 13: low-pass filtering section
14: signal selector
81: one-field delay section
82: differential image section
83: binarization section

The invention claimed is:

1. An image signal processing method employed for a color image display device using a plurality of light-emitting materials having difference in afterglow-lasting time, with respect to at least image signals corresponding to a light-emitting material with afterglow lasting a short time, the method capable of providing a current-field image signal with low-pass filtering by characteristically different low-pass filters disposed at branches in a circuit, and mixing outputs fed from the low-pass filters to produce an extended image signal, and adding a pseudo afterglow signal to the current-field image signal by mixing the current-field image signal with the extended image signal for an area in which a one-field-before image signal is greater than the current-field image signal.

2. The image signal processing method of claim 1, wherein the extended image signal is obtained through processes of: determining a value of tap T (where, T takes an integer) used for low-pass filtering for each pixel; providing a current-field image signal with the low-pass filtering by characteristically different low-pass filters; and then selecting a maximum output from outputs fed from the low-pass filters.

3. The image signal processing method of claim 2, wherein a value of tap T is determined through processes of: detecting a moving area according to a differential signal between a current-field image signal and a one-field-before image signal; calculating movement velocity of an image pattern according to the moving area; and converting the movement velocity into the value of tap T.

4. The image signal processing method of claim 3, wherein a moving area is determined by providing a differential signal between a one-field-before image signal and a current-field image signal with binarization process according to a threshold depending on afterglow characteristics of light-emitting materials.

5. The image signal processing method of claim 2, wherein tap T takes 0 or takes a value of powers of 2.

6. The image signal processing method of claim 2, wherein each low-pass filter defines compression constant n (n takes a constant); and multiplies a current-field image signal corresponding to T×n pixels disposed rightward and leftward from a target pixel by a predetermined value; and then obtains an average of the multiplied result.

7. The image signal processing method of claim 6, wherein compression coefficient n is determined so as to be powers of 2 or to be a reciprocal of powers of 2.

8. The image signal processing method of claim 1, wherein according to a result of comparison between an extended image signal and a current-field image signal, either the extended image signal or the current-field image signal is selected as output, and the current-field image signal is mixed with the extended image signal.

9. An image signal processing apparatus for driving a color image display device employing a plurality of light-emitting materials having difference in afterglow-lasting time, the apparatus comprising:

pseudo afterglow adding means for adding a pseudo afterglow image signal to an image signal at least corresponding to a light-emitting material having a short afterglow time, the pseudo afterglow adding means further including:

extended image signal generating means for providing a current-field image signal with low-pass filtering by characteristically different low-pass filters, and combining outputs from each low-pass filter to generate an extended image signal including a pseudo afterglow signal; and image generating means for mixing the current-field image signal with the extended image signal, and adding the pseudo afterglow signal to the current-field image signal for an area in which a one-field before image signal is greater than the current-field image signal.

10. The image signal processing apparatus of claim 9, wherein the extended image signal generating means further includes a tap value determining unit for determining a value of tap T (T takes an integer) for each pixel for low-pass filtering; a plurality of low-pass filtering sections for providing a current-field image signal with the low-pass filtering according to the value of tap T defined at the tap value determining unit; and a signal selector for selecting a maximum output in outputs fed from the low-pass filters.

11. The image signal processing apparatus of claim 10, wherein the tap value determining unit further includes a moving area detector for detecting a moving area having moving image according to a differential signal between a current-field image signal and a one-field-before image signal; a movement velocity calculator for determining movement velocity of an image pattern from the moving area; and a tap value converter for converting the movement velocity fed from the movement velocity calculator into a value of tap T according to a predetermined rule.

12. The image signal processing apparatus of claim 11, wherein the tap value converter converts the movement velocity into tap T so that tap T takes 0 or takes values of powers of 2.

13. The image signal processing apparatus of claim 11, wherein a moving area detector further includes a one-field delay section for generating a one-field-before image signal by providing a current-field image signal with one-field delay; a differential image section for calculating a differential signal between the current-field image signal and the one-field-before image signal; and a binarization section for binarizing the differential signal according a threshold that depends on afterglow characteristics of light-emitting materials and then detecting a moving area in which the differential signal is greater than the threshold.

14. The image signal processing apparatus of claim 10, wherein each low-pass filtering section further includes a tap value multiplier that defines compression coefficient n (n takes an integer) and multiplies tap T by compression coefficient n; an image multiplier that multiplies a current-field image signal by a predetermined value; and a filter that receives, from the image multiplier, output signals corresponding to T×n pixels disposed rightward and T×n pixels disposed leftward from a target pixel, and then calculates an average of the output signals.

15. The image signal processing apparatus of claim 14, wherein compression coefficient n is determined to be powers of 2 or to be a reciprocal of powers of 2.

16. The image signal processing apparatus of claim 9, wherein an image mixing means further contains a signal comparing section for comparing an extended image signal with a current-field image signal; and a signal selecting section for selecting either the extended image signal or the current-field image signal according to a result from the signal comparing section.

* * * * *